United States Patent [19]

Klein, Sr.

[11] 4,312,679

[45] Jan. 26, 1982

[54] METHOD FOR CLEANING CLOGGED PIPES

[76] Inventor: Richard W. Klein, Sr., 1201 S. Eads St., #212, Arlington, Va. 22202

[21] Appl. No.: 890,395

[22] Filed: Mar. 27, 1978

[51] Int. Cl.[3] ..... B08B 1/04; B08B 3/02; B08B 9/02

[52] U.S. Cl. ..... 134/8; 134/22 C; 134/167 C; 15/104.3 SN

[58] Field of Search ..... 134/8, 22 C, 167 C; 15/104.1 R, 104.3 R, 104.3 SN

[56] References Cited

U.S. PATENT DOCUMENTS

| | | | |
|---|---|---|---|
| 1,137,580 | 4/1915 | Cole | 15/104.3 R |
| 1,344,249 | 6/1920 | Stewart | 15/104.3 R |
| 1,796,340 | 3/1931 | Nowakowski | 15/104.3 SN |
| 1,803,425 | 5/1931 | Cunningham | 15/104.3 R |
| 2,568,347 | 9/1951 | Lundelius | 15/104.3 R |
| 2,608,421 | 8/1952 | Schnepp | 15/104.3 SN |
| 3,080,265 | 3/1963 | Maasberg | 134/167 C |
| 3,370,599 | 2/1968 | Ciaccio | 15/104.3 SN |
| 3,880,176 | 4/1975 | Horne | 134/167 C |

*Primary Examiner*—Richard V. Fisher
*Attorney, Agent, or Firm*—John J. Byrne

[57] ABSTRACT

A device for cleaning clogged pipes includes an elongated flexible tube, a heavy coil surrounding the flexible tube in close contact with the exterior surface thereof, and a nozzle at one end of the flexible tube. The nozzle has a plurality of perforations which are in communication with the interior of the flexible tube and which are oriented radially of the flexible tube. The device is particularly well adapted for use in a method of cleaning a clogged pipe wherein the nozzle is first forced through the material clogging the pipe, water is then discharged through the perforations in the nozzle, and the nozzle is then pulled backwards towards the material clogging the pipe while water continues to be discharged through the perforations in the nozzle.

2 Claims, 3 Drawing Figures

METHOD FOR CLEANING CLOGGED PIPES

FIELD OF THE INVENTION

This invention pertains to flexible augers of the type which are used to remove obstruction in pipes, particularly sewage pipes. More particularly, it pertains to such augers which contain an internal passageway for water which is used to aid in the removal of obstructions in pipes.

BACKGROUND OF THE INVENTION

Flexible augers of the type which are used to remove obstructions in sewage pipes and which contain an internal passageway for water used to aid in the removal of obstructions in the pipes are well known. One such auger is, for example, shown in U.S. Pat. No. 2,608,421, issued Aug. 26, 1952, to L. W. Schnepp. Such augers, however, have not come into general use, due to deficiencies both in their design and in the way in which they are used. For instance, the auger disclosed in the Schnepp patent is designed to discharge water in the forward direction, and its method of use is to insert the auger in the clogged pipe until its forward end is just upstream of the clog, then turn the water on to aid in forcing the clogging materials on down the pipe. The predictable result if the clog is not immediately broken up is that filthy water will back up in the pipe and exit out the inlet—probably spraying in the user's face.

OBJECTS OF THE INVENTION

It is, therefore, a general object of the invention to provide a flexible auger of the type described which will obviate or minimize problems of the type previously described.

It is a particular object of the invention to provide such a device which will be extremely effective in cleaning out clogged pipes, yet which will not cause water to back up in the pipe if the clog is not immediately broken up.

Other objects and advantages of the present invention will become apparent from the following detailed description of a preferred embodiment thereof taken in conjunction with the accompanying drawings.

DETAILED DESCRIPTION OF THE PRESENTLY PREFERRED EMBODIMENT

Figure 1:
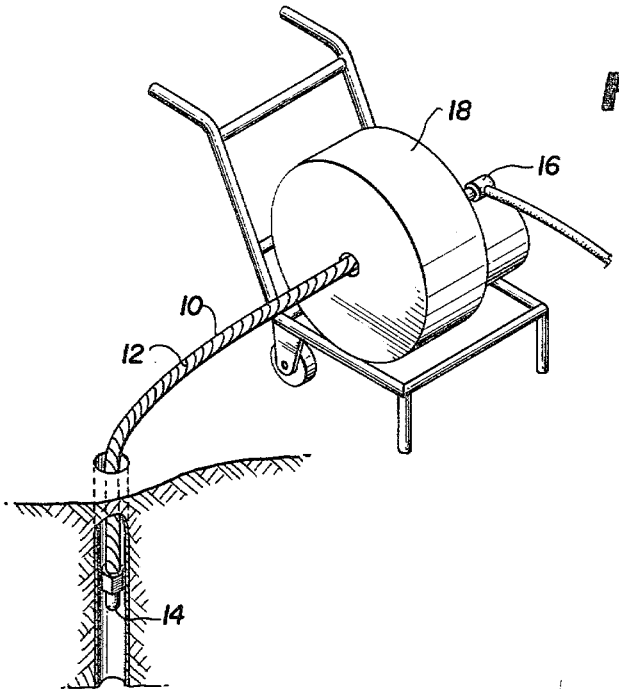
FIG. 1 is a perspective view of the presently preferred embodiment of the subject invention in use.
Figure 2:
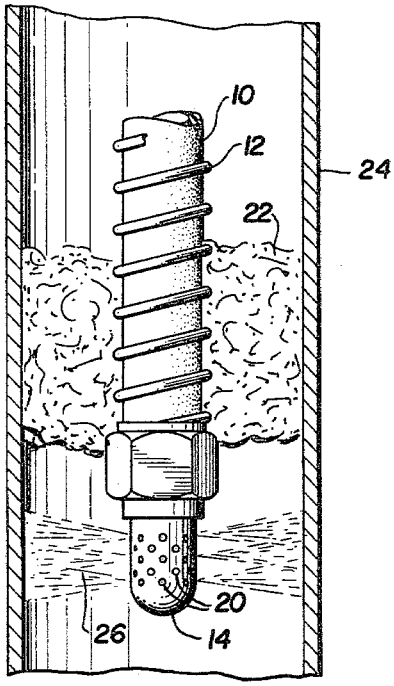
FIG. 2 is a sectional view of a portion of a clogged pipe showing the working end of the presently preferred embodiment of the subject invention in use.
Figure 3:
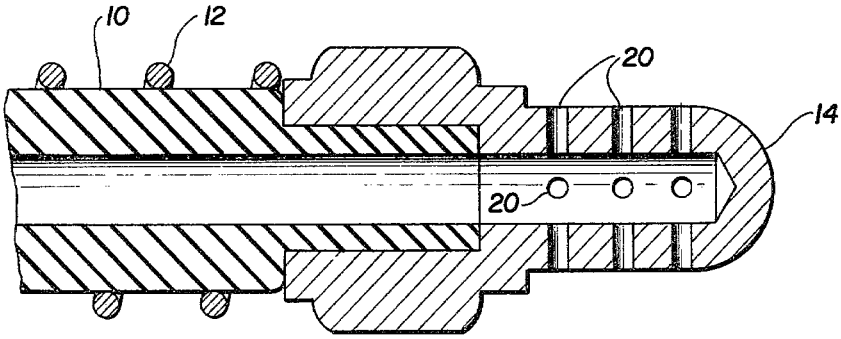
FIG. 3 is a cross-sectional view of the working end of the presently preferred embodiment of the subject invention.

The presently preferred embodiment of the subject invention illustrated in FIGS. 1–3 comprises an elongated flexible tube 10, a heavy coil 12 surrounding the flexible tube 10 in close contact with its exterior surface, a nozzle 14 at the downstream end of the flexible tube 10, means 16 for connecting the flexible tube 10 to a source of water (not shown) at the upstream end of the flexible tube 10, and means 18 for rotating the elongated flexible tube 10, the heavy coil 12, and the nozzle 14. The flexible tube 10 is preferably formed of reinforced rubber or a durable, corrosion-resistant plastic, but the particular material of which it is formed is of no importance to this invention. Similarly, the heavy coil 12 is preferably formed of a durable, corrosion-resistant metal, but the particular material of which it is formed is similarly of no importance to the invention. The nozzle 14 is preferably, as shown, a separate element made of a heavy, durable, corrosion-resistant metal or corrosion-resistant plastic and attached to the downstream end of the flexible tube 10 by any appropriate means. The means 18 can appropriately comprise a motor-driven reeling and unreeling drum of the type shown in FIG. 1. Since such drums are basically conventional, the one illustrated in FIG. 1 will not be described in detail here. The one modification to the purely conventional reeling and unreeling drum shown in FIG. 1 is that the upstream end of the flexible tube 10 passes through an aperture in the rear of the drum, where the flexible tube 10 is connected to a source of water (not shown) by the previously mentioned means 16. If desired, a soap or detergent dispenser feeding into the flexible tube may also be provided, and of course the source of water preferably is adapted to provide hot water to aid in the cleaning of clogged pipes.

Focusing now on the nozzle 14, best seen in FIGS. 2 and 3, it will be seen that the nozzle 14 has an imperforate forward surface and a plurality of perforations 20 which are in communication with the interior of the flexible tube 10 and which are oriented radially of the flexible tube 10. Thus, as illustrated in FIG. 2, water discharging from the perforations 20 sprays directly on or towards the side of the clogged pipe, not forwardly as is conventional with prior-art flexible augers of this general type.

In use, as shown in FIG. 2, the nozzle 14 is forced through the material 22 clogging the pipe 24, water 26 is then discharged through the perforations 20 in the nozzle 14, and the nozzle 14 is pulled backwards toward the material 22 while discharge of the water 26 through the perforations 20 is continued. Preferably, but not essentially, the nozzle 14 is rotated while it is being pulled backwards toward the material 22, thereby constantly changing the point of impact of the water spray and helping to dislodge the materials 22.

In practice the device described herein has been found to be extremely effective in cleaning out clogged pipes, and no difficulty has been experienced with water backing up in the pipe. Moreover, the device is extremely durable and subject to virtually no mechanical malfunctions. For instance, clogging of the perforations 20 has not proved to be a problem since they are on a radial surface and are therefore not forced directly into the clogging material and since the water being discharged through the perforations 20 under high pressure tends to keep them clean in any event.

Caveat

While the present invention has been illustrated by a detailed description of a preferred embodiment thereof, it will be obvious to those skilled in the art that various changes in form and detail can be made therein without departing from the true scope of the invention. In that reason, the invention must be measured by the claims appealed hereto and not by the foregoing preferred embodiment.

I claim:

1. A method of cleaning a clogged pipe employing a device comprising:

(a) an elongated flexible tube;

(b) a heavy coil surrounding said flexible tube in close contact with the exterior surface thereof;

(c) a nozzle at one end of said flexible tube, said nozzle having a plurality of perforations which are in communication with the interior of said flexible tube and which are oriented radially of said flexible tube; and (d) first means for connecting said flexible tube to a source of water, said first means being located at the other end of said flexible tube, said method comprising the steps of:

(1) forcing said nozzle through the material clogging the pipe;

(2) discharging water through the perforations in said nozzle after it has passed through the material clogging the pipe; and (3) pulling the nozzle backwards toward the material clogging the pipe while continuing to discharge water through the perforations in the nozzle.

2. A method as recited in claim 1 wherein (a) the device further comprises second means for rotating said elongated flexible tube, said heavy coil, and said nozzle and (b) said method further comprises the step of rotating said elongated flexible tube, said heavy coil, and said nozzle as said nozzle is pulled backwards toward the material clogging the pipe.

* * * * *